United States Patent [19]

Smith

[11] Patent Number: 4,987,619

[45] Date of Patent: Jan. 29, 1991

[54] MODULAR BATHING CABINET AND METHOD OF FABRICATING SAME

[76] Inventor: Lee A. Smith, 3901 Foxcroft Rd., Charlotte, N.C. 28211

[21] Appl. No.: 241,332

[22] Filed: Sep. 7, 1988

[51] Int. Cl.[5] ..... A47K 3/22

[52] U.S. Cl. ..... 4/612; 4/614; 4/604; 4/611; 4/595; 52/34; 52/79.9; 52/264

[58] Field of Search ..... 4/612, 613, 614, 611, 4/604, 600, 595, 584, 596, 449, 506, 478; 52/34, 79.5, 79.9, 264

[56] References Cited

U.S. PATENT DOCUMENTS

| | | | |
|---|---|---|---|
| 1,859,017 | 5/1932 | Barce | 4/613 |
| 2,002,789 | 5/1935 | Niedecken | 4/612 |
| 2,614,664 | 10/1952 | Sherron | 52/264 |
| 3,132,350 | 5/1964 | Carlson . | |
| 3,149,347 | 9/1964 | Embroden | 52/262 |
| 3,445,866 | 5/1969 | Shields | 4/506 |
| 3,447,167 | 6/1969 | Harding | 4/478 |
| 3,562,821 | 2/1971 | Queen | 4/604 |
| 3,587,118 | 6/1971 | Compton | 4/604 |
| 3,588,925 | 6/1971 | Kuypers et al . | 4/595 |
| 4,109,426 | 8/1978 | Dobija | 4/614 |
| 4,167,084 | 9/1979 | Brunton | 4/506 |
| 4,316,295 | 2/1982 | Whitney et al. | 4/600 |
| 4,337,540 | 7/1982 | Lindeman | 4/546 |
| 4,423,528 | 1/1984 | Wiedmeier | 4/613 |
| 4,424,598 | 1/1984 | Cima | 4/524 |
| 4,432,103 | 2/1984 | Hunziker | 4/525 |
| 4,471,501 | 9/1984 | Heymann | 4/599 |
| 4,553,276 | 11/1985 | Paradis | 4/612 |

OTHER PUBLICATIONS

German Offenlegungsschrift No. 3332683-See FIGS. 1-5 3/28/85.

U.K. Patent Application No. 2149299A-see FIGS. 1 and 2 6/12/85.

"An Illustrated Handbook of the Handicapped Section of the North Carolina State Building Code", by Mace and Laslett, 1974, p. 75 GlasTec Product Brochure, Models 323; 363; 384; 521/526; 8 pages.

*Primary Examiner*—Henry J. Recla
*Assistant Examiner*—Edward C. Donovan
*Attorney, Agent, or Firm*—Bell, Seltzer, Park & Gibson

[57] ABSTRACT

A modular bathing cabinet is disclosed which is adapted to be easily transported to and assembled at the location of final use. The bathing cabinet may be in the form of either a shower stall or a bathing tub, and it includes a base, and an upright enclosure which includes a pair of opposite side sections which are of generally L-shape in cross-section and which are joined to each other along a vertical junction line in the back wall of the enclosure. Each of the side sections includes a plurality of horizontal reinforcing metal straps fixed along the outside surface, and the reinforcing straps of the side sections are bolted together to form a secure and rigid interconnection along the vertical junction line. Also, the straps are directly connected to the vertical wall studs of the building, to further rigidify the structure.

20 Claims, 5 Drawing Sheets

MODULAR BATHING CABINET AND METHOD OF FABRICATING SAME

FIELD OF THE INVENTION

The present invention relates to a modular bathing cabinet, such as a shower stall or a bathing tub, and which is adapted to be transported in a disassembled condition and assembled at the location of final installation and use.

BACKGROUND OF THE INVENTION

It has long been conventional practice to fabricate shower and tub enclosures by hand, using ceramic tiles to form the floor and walls of the enclosure. Such enclosures are expensive, and they are difficult to clean. In an effort to avoid these disadvantages, the ceramic tile enclosures largely have been supplanted by prefabricated enclosures which are made from fiberglass, or molded from acrylic or similar plastic materials. While these enclosures have the advantage of being less expensive and easier to clean, they are bulky, which renders them difficult to transport and deliver to the point of installation. This problem is particularly severe where older homes are being remodeled, since the bulky enclosure often will not fit through the existing doorways. Also, such prior prefabricated enclosures are difficult to mount rigidly to the supporting structure of the building in which the enclosure is installed.

Prior attempts have been made to manufacture such bathing cabinets from several components, note for example the U.S. Pat. No. 3,149,347 to Embroden. However, it is not believed that any of these prior designs have met with significant commercial success, primarily because the components could not be interconnected in a manner to provide the desired degree of rigidity and strength.

It is accordingly an object of the present invention to provide a modular bathing cabinet of the described type and which may be transported in a disassembled condition and assembled at the location of final installation and use, and which provides a high degree of rigidity and strength when assembled.

It is also an object of the present invention to provide a modular bathing cabinet of the described type which is easy to assemble at the location of final assembly, and which is pleasing in appearance.

It is still another object of the present invention to provide a modular bathing cabinet wherein the sectional components of the cabinet include provision for rigidly attaching the components directly to the interior wall studs of the building.

It is a further object of the present invention to provide a modular bathing cabinet of the described type which is adapted for use in fabricating either a shower stall or a bathing tub.

SUMMARY OF THE INVENTION

These and other objects and advantages of the present invention are achieved in the embodiments illustrated herein by the provision of a modular bathing cabinet which comprises a horizontally disposed base having a generally rectangular outer periphery in plan view, an enclosure of generally U-shape in horizontal cross-section and having a vertical back wall and opposite vertical side walls, with said enclosure being positioned upon the outer periphery of the base and extending vertically upwardly therefrom. The enclosure comprises a plurality of upright side sections which are positioned in an adjacent side by side arrangement and define a vertical junction line between each pair. The bathing cabinet further comprises a plurality of rigid reinforcing straps affixed to each of the upright side sections, with the reinforcing straps of each side section extending horizontally and in a vertically spaced apart arrangement, and with each reinforcing strap of each side section being connected to a respective one of the reinforcing straps of each adjacent side section along said vertical junction line and so as to define a plurality of horizontal reinforcing bands which extend continuously along the back wall and both side walls of said enclosure.

In a preferred embodiment, the enclosure comprises a pair of upright side sections, with each of said side sections comprising a rear panel and a side panel which are disposed at right angles to each other and such that the rear panels of the side sections are aligned along a vertical junction line and collectively define the back wall of the enclosure, and the side panels define respective ones of the side walls of the enclosure.

Preferably, the reinforcing straps are disposed along the outside surface of the upright side sections, and each of the reinforcing straps includes a plurality of securing members extending outwardly therefrom for securing the same directly to the interior wall studs of the building.

To install the modular bathing cabinet of the present type, the base is mounted upon a horizontal supporting floor, and a plurality of vertical wall studs are mounted to the supporting floor so as to be positioned along opposite sides of the base when the base is mounted upon the floor. The pair of side sections are secured to each other by interconnecting respective ones of the straps, and so as to form a U-shaped enclosure having a back wall, opposite side walls, and an open front. The enclosure is positioned upon the base so as to define a bathing cabinet with an open front, and the securing members of the straps are secured directly to the vertical wall studs.

BRIEF DESCRIPTION OF THE DRAWINGS

Some of the objects and advantages having been stated, others will appear as the description proceeds, when considered in conjunction with the accompanying drawings, in which.

BRIEF DESCRIPTION OF THE PREFERRED EMBODIMENTS

Figure 5:
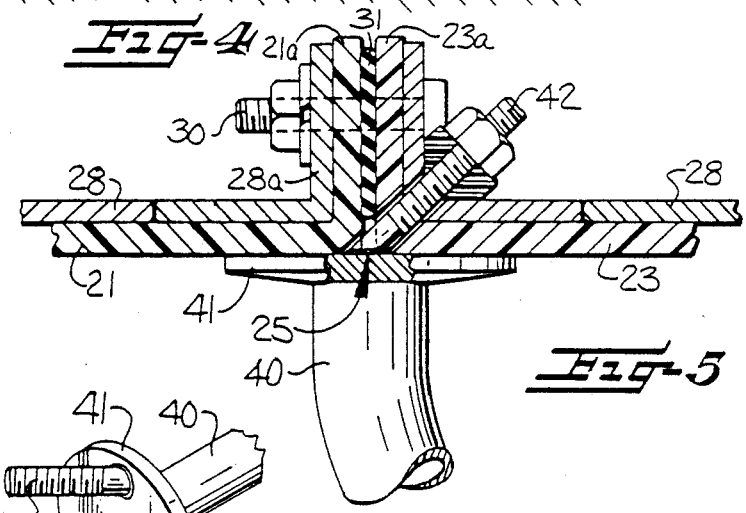
FIG. 5 is an enlarged fragmentary view of the portion shown within the circle 5 of FIG. 3.

Referring more particularly to the drawings, FIGS. 1–8 illustrate one preferred embodiment of the present invention, and which comprises a modular bathing cabinet 10 which is composed of a base 12, and an enclosure of generally U-shape in horizontal cross-section and which is composed of a back wall 14, opposite side walls 16, 17, and an open front. The enclosure in turn is composed of a pair of upright side sections 18, 19 (FIG. 2), with the two side sections being generally L-shaped in cross section and being mirror images of each other. Also, the side section 18 comprises a rear panel 21 and a side panel 22 which are disposed at right angles to each other, and the side section 19 includes a rear panel 23 and a side panel 24 which are at right angles to each other. The rear panels 21, 23 are aligned along a vertical junction line 25. As best seen in FIG. 5, the vertical edges of the rear panels 21, 23 which extend along the junction line include an outwardly extending integral flange 21*a*, 23*a* respectively, with the flanges of the two panels overlying and being secured to each other in the manner further described below. Thus the rear panels 21, 23 of the two side sections 18, 19 collectively define the back wall 14 of the enclosure, and the side panels 22, 24 of the side sections define respective ones of the side walls 16, 17 of the enclosure.

A plurality of rigid reinforcing straps 28 are affixed to the outside surface of each of the side sections 18, 19, with the reinforcing straps 28 of each side section being L-shaped and extending horizontally along the side panel and rear panel thereof, and in a vertically spaced apart arrangement. Also, the straps 28 of each side section are horizontally aligned with respective ones of the straps of the other side section, and the aligned straps are connected to each other at the junction line 25. More particularly, each reinforcing strap 28 includes an outwardly directed integral extension 28*a* adjacent the vertical junction line, with the extensions of the interconnected straps being parallel to and overlying each other. This interconnection is effected by a bolt 30, which extends laterally through the two extensions 28*a*, and through the overlying flanges 21*a*, 23*a* of the side sections. By this arrangement, the interconnected straps define a plurality of horizontal reinforcing bands which extend continuously along the back wall 14 and both side walls 16, 17 of the enclosure. Also, to provide a water tight seal along the vertical junction line, there is preferably provided a vertically extending sealing member 31 between the two flanges 21*a*, 3*a* of the side sections, and which is compressed by the bolts 30.

Figure 7:
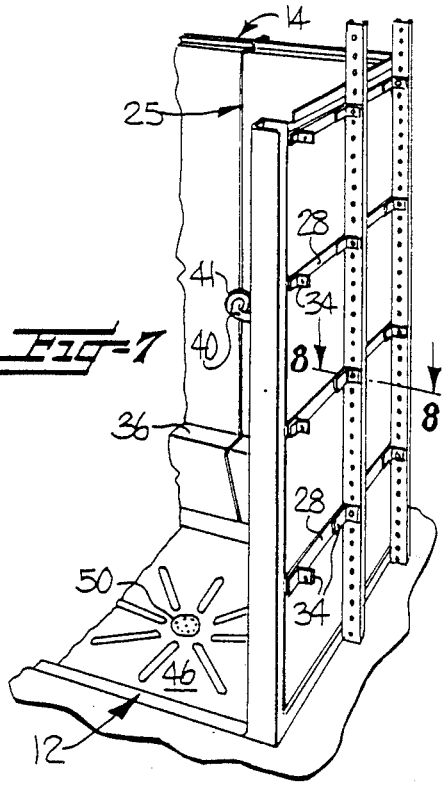
FIG. 7 is a fragmentary perspective view illustrating the manner in which the straps of one side section of the cabinet are attached to the supporting wall studs.
Figure 8:
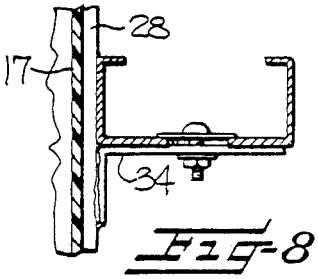
FIG. 8 is a vertical sectional view taken along the line 8—8 of FIG. 7.
Figure 9:
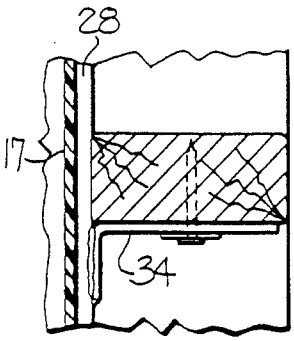
FIG. 9 is a view similar to FIG. 8 but illustrating the manner in which the straps may be secured to a wooden as opposed to metal wall stud.
Figure 6:
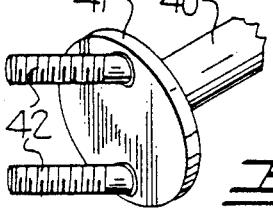
FIG. 6 is a fragmentary perspective view of the mounting portion of the grab bar shown in FIG. 5.
Figure 19:
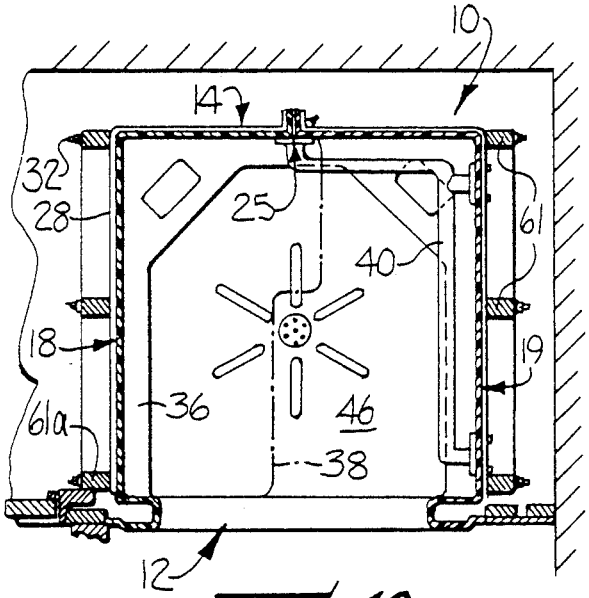
FIG. 19 is a vertical sectional view taken substantially along the line 19—19 of FIG. 18.

The reinforcing straps 28 are disposed along the outside surface of the side sections 18, 19, and each of the reinforcing straps includes a plurality of securing members extending outwardly therefrom for securing the same to a building wall stud or the like. As seen in the embodiment of FIGS. 1–4, these securing members are in the form of threaded rods 32, which are adapted to extend through openings in the wooden or metal building studs in the manner best seen in FIG. 19. Alternatively, the securing members may take the form of L-shaped brackets 34 as shown in FIGS. 7–9, which are adapted to be connected to metal building studs as shown in FIGS. 7 and 8, or wooden building studs as shown in FIG. 9.

The base 12 and two side sections 18, 19 of the cabinet 10 may be fabricated from conventional fiberglass materials, or molded from acrylic or other plastic sheeting, in a manner well known in the art. Also, the reinforcing straps 28 are preferably formed of a rigid metal, with the securing members 32 or 34 being welded or otherwise joined thereto. The metal straps 28 may be joined to the fiberglass or acrylic side sections by a suitable adhesive, such as epoxy. Also, in the case of acrylic sheeting, the straps may be joined by positioning them along the outside surface of the sheeting, and then coating the straps and the adjacent surface with a mixture of epoxy and a catalyst, and such that the metal straps become essentially embedded in the material of the side sections. Suitable caps may be placed on the threaded rods 32 to protect them from the epoxy coating.

In the illustrated embodiment of FIGS. 1–4, a total of four reinforcing bands encircle the outside of the enclosure, but it will be understood that a different number of bands may be employed in accordance with the present invention. Also, each of the upright side sections 18, 19 includes an inwardly directed horizontal ledge 36 which extends along substantially the full length of the side panel 22, 24 and the rear panel 21, 23 thereof, with the ledges of the two side sections being horizontally aligned. A generally planar, L-shaped seat 38 may be horizontally disposed upon and secured to the horizontal ledge 36 of one of the side sections. The seat 38 may be secured by any conventional structure, such as by means of an adhesive, or bolts which extend vertically through the ledge. Also, it will be apparent that the seat is designed to be readily attached to the ledge of either of the side sections, to provide for either a right-hand or left-hand enclosure.

In the illustrated embodiment, a horizontally directed grab bar 40 is mounted within the enclosure, which is required to meet the code requirements for a handicapped enclosure in many states. The grab bar 40 is aligned so as to overlie one of the reinforcing straps 28, and the grab bar includes a plurality of bolts which extend through the wall of the side section and through suitable openings in the reinforcing straps, for securing the grab bar on the wall. Viewing FIGS. 5 and 6, it will be noted that in the illustrated embodiment one of the ends of the grab bar directly overlies the junction line 25, and this end includes a circular end plate 41 which mounts two threaded bolts 42 which extend in an inclined direction through the wall of the side section and the associated reinforcing strap 28. The illustrated embodiment of the enclosure also includes a water outlet nozzle 44 of conventional construction and which is mounted on the inside surface of the side panel of one of the upright side sections.

Figure 1:
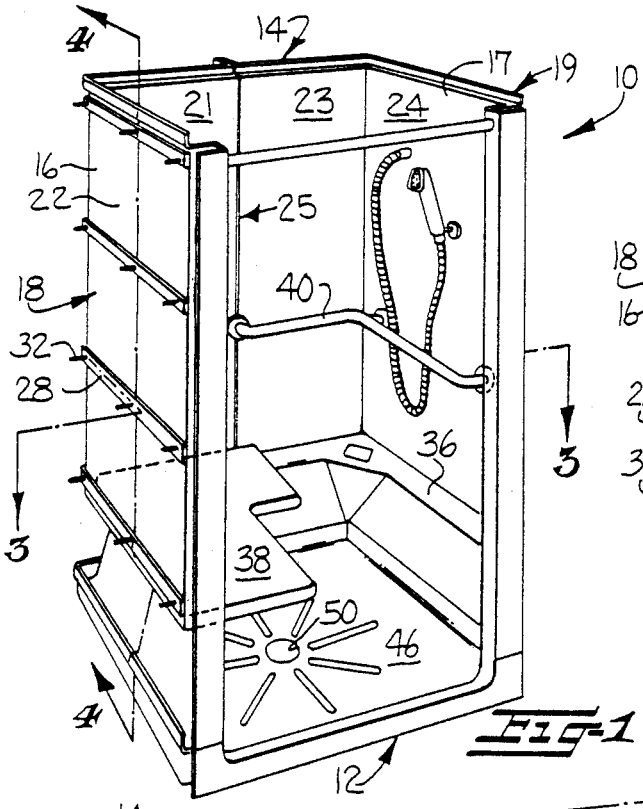
FIG. 1 is a perspective view of a modular bathing cabinet, and specifically a shower stall, in accordance with the present invention.
Figure 3:
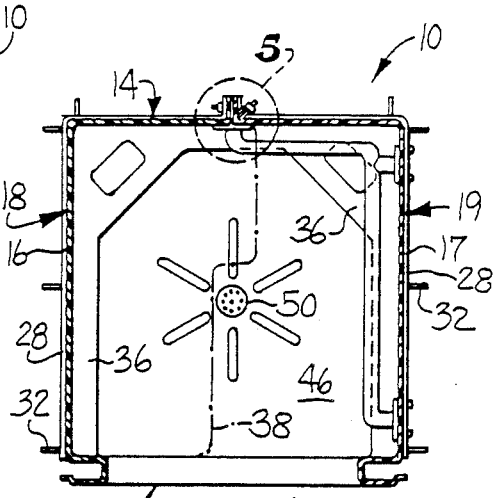
FIG. 3 is a horizontal sectional view taken substantially along the line 3—3 of FIG. 1.
Figure 2:
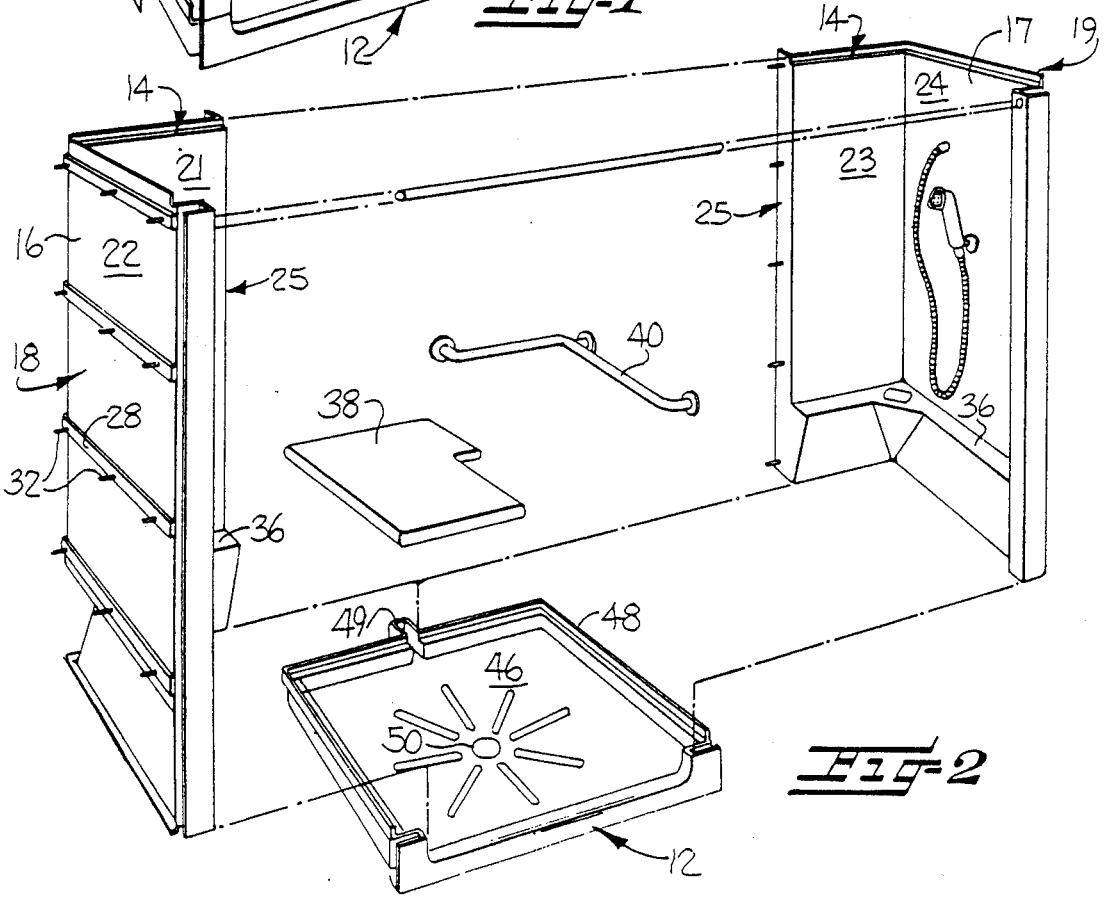
FIG. 2 is an exploded perspective view of the shower stall shown in FIG. 1.
Figure 4:
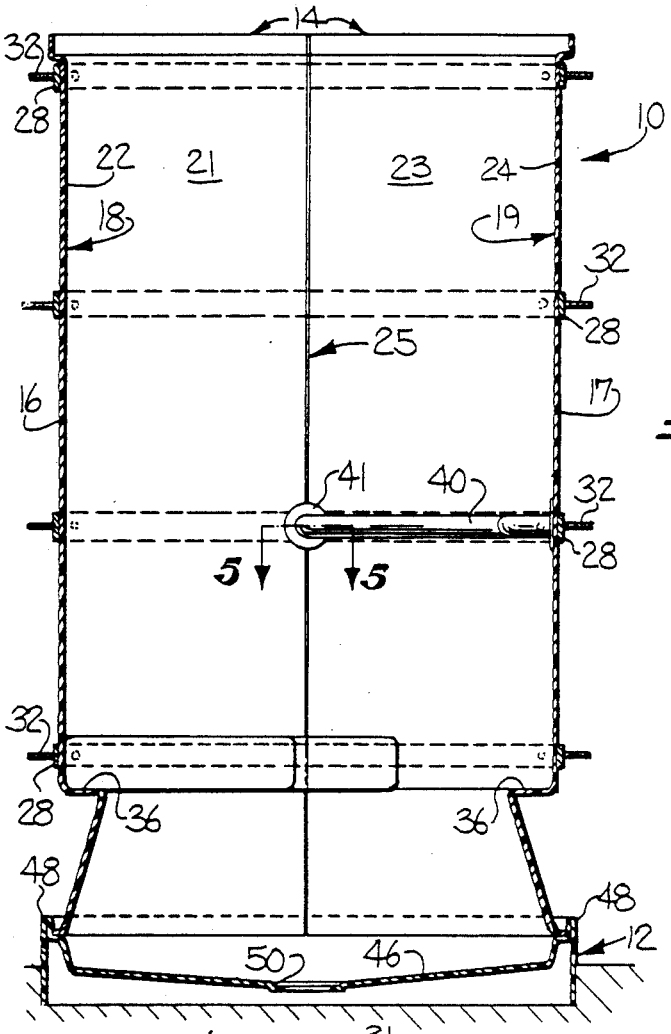
FIG. 4 is a vertical sectional view taken substantially along the line 4—4 of FIG. 1.

As best seen in FIG. 2, the base 12 of the cabinet 10 includes a generally horizontal bottom wall 46 of rectangular outline, which is adapted to have the user stand thereupon in use, and a peripheral outer wall which includes an upwardly extending integral lip 48 which extends along three sides and so as to be adapted to overlie the outside of the lower edge of the enclosure so as to provide a water tight interengagement. Also, the rear edge of the base includes a rearwardly extending rectangular offset 49 which is sized to receive the flanges 21*a*, 23*a* of the side sections along the vertical junction line. Still further, the base includes a central opening 50 which is adapted to be connected to a conventional drain.

Figure 10:
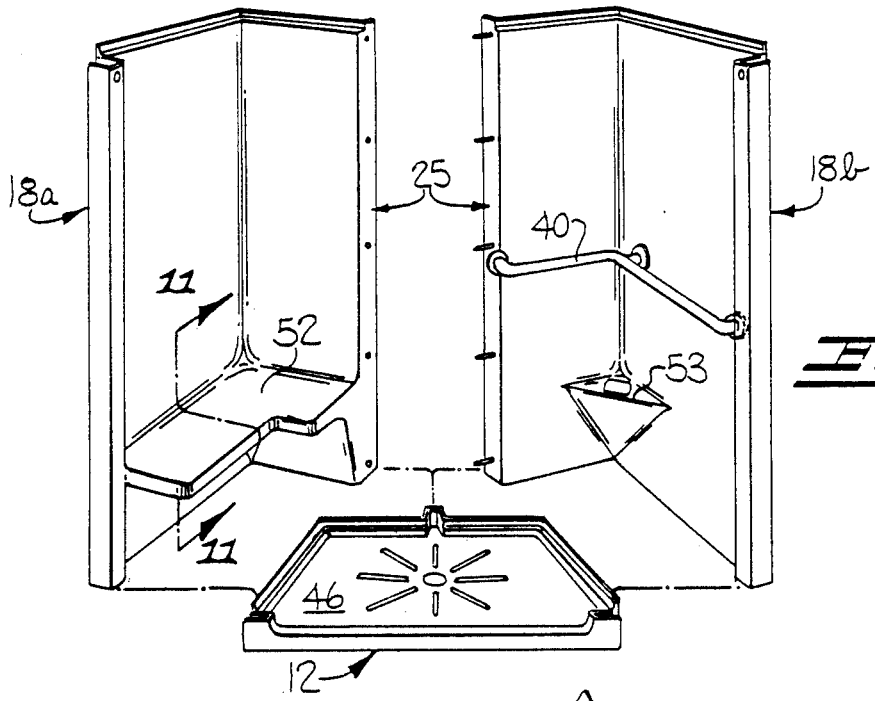
FIG. 10 is an exploded perspective view of another embodiment of a shower stall in accordance with the present invention, and which incorporates an integrally molded seat.
Figure 11:
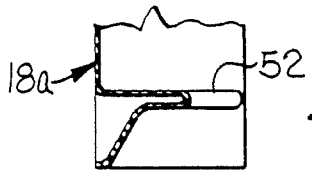
FIG. 11 is a sectional view of the seat and taken substantially along the line 11—11 of FIG. 10.

FIGS. 10 and 11 illustrate a modified embodiment of the enclosure of the present invention, and wherein the side sections 18*a*, 19*a* are of molded construction, and the left side section 18*a* as seen in FIG. 10 includes an integrally formed seat 52. Also, the right side section 19*a* includes an integrally molded soap dish 53 which is formed in the corner opposite the seat and below the grab bar 40. The enclosure of FIGS. 10 and 11 is otherwise similar in structure to the above described embodiments.

Figure 12:
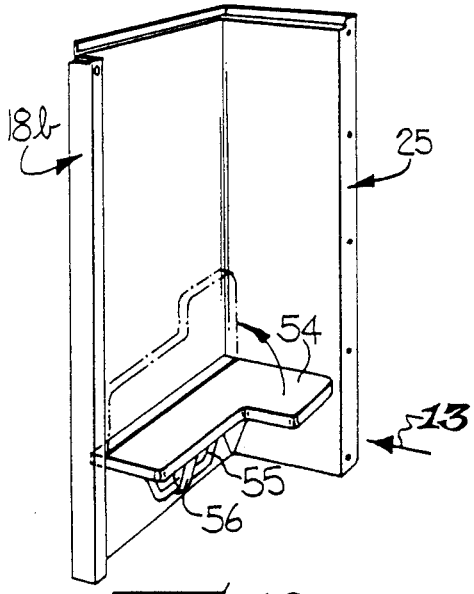
FIG. 12 is a perspective view of the left side section of the enclosure as shown in FIG. 10, but illustrating a further embodiment which includes a folding seat as opposed to an integrally molded seat.
Figure 13:
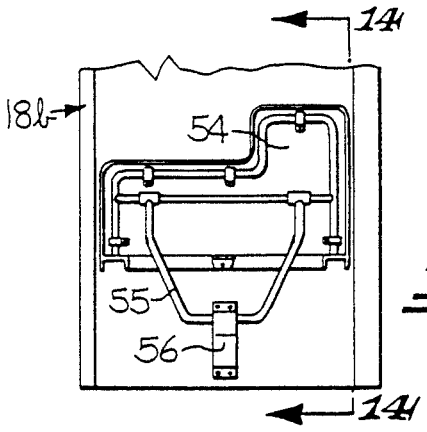
FIG. 13 is a fragmentary side elevation view of the side section shown in FIG. 12, and with the seat in the folded up or storage position.
Figure 14:
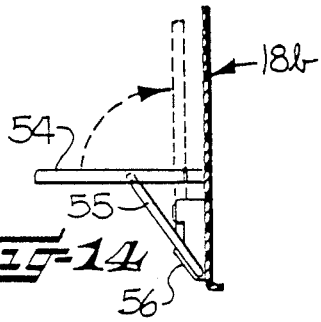
FIG. 14 is a vertical sectional view of the seat shown in FIG. 12.
Figure 15:
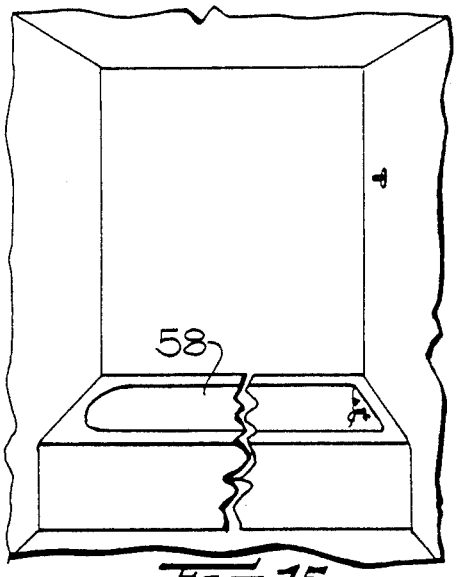
FIGS. 15–18 are perspective views illustrating the steps in the method used in remodeling an existing bathing tub by converting it to a shower stall in accordance with the present invention.

FIGS. 12–14 illustrate still another embodiment wherein the left side section 18*b* includes a fold-up seat 54 attached thereto, with the seat 54 being pivotable between a horizontal operative position and a raised storage position. The seat 54 as illustrated includes an underlying U-shaped support bracket 55 and retainer 56. A seat of this construction is well known in the art and is commercially available.

Figure 16:
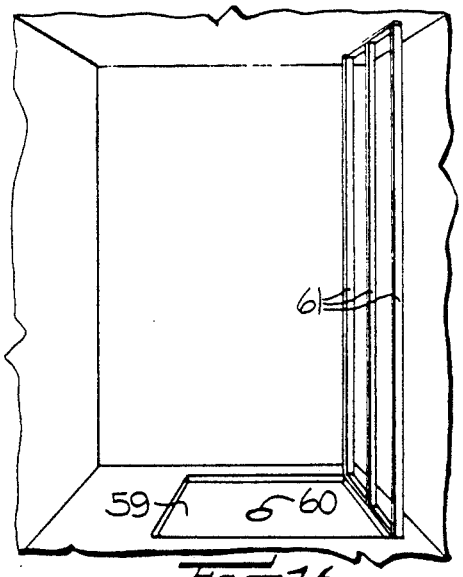
Figure 17:
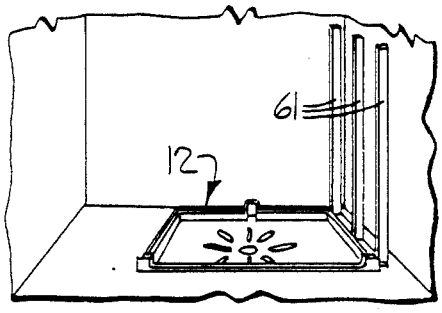
Figure 18:
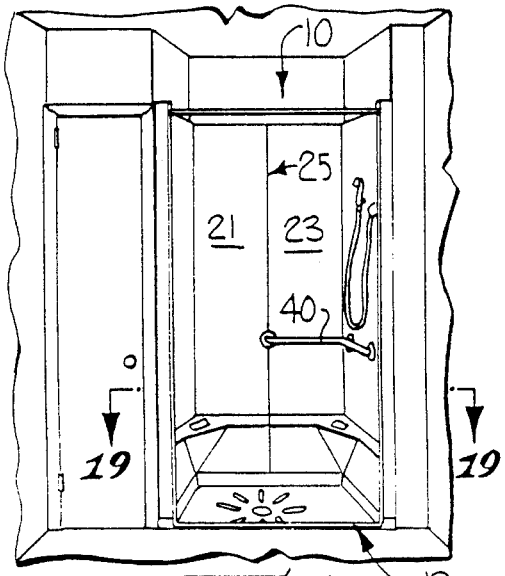

FIGS. 15–18 illustrate a method of installing the modular bathing cabinet 10 of the type described above, and particularly the method of removing an existing tub and substituting the cabinet of the present invention, which is typical for many home remodeling applications. In the illustrated method, the existing tub 58 is initially broken and removed in the manner schematically illustrated in FIG. 15, and a depression 59 is formed in the floor for receiving the base 12 of the bathing cabinet and as seen in FIG. 16, and the depression includes a drain outlet 60. Three wall studs 61, i.e. wooden 2×4's, are then mounted to the supporting floor so as to extend vertically along one side of the base 12. The base 12 is then placed in position as shown in FIG. 17, and connected to the drain outlet 60 in the conventional manner. Next, suitable holes are drilled through the vertical wall studs 61 for receiving the threaded rods 32 which are attached to the straps 28, and the two side sections 18, 19 are then assembled to each other along the junction line 25 to form the enclosure. The enclosure is then positioned upon the base 12, with the threaded rods 32 extending through the studs 61, and the threaded rods are then secured in place by the addition of nuts. Thereafter, three additional vertical wall studs 61*a* are positioned along the opposite side of the enclosure, with these studs including holes for receiving the threaded rods 32 along the opposite side of the enclosure. The studs are then secured to the floor and ceiling, and the installation is then completed by the addition of the finishing wood work as shown in FIG. 18.

Figure 20:
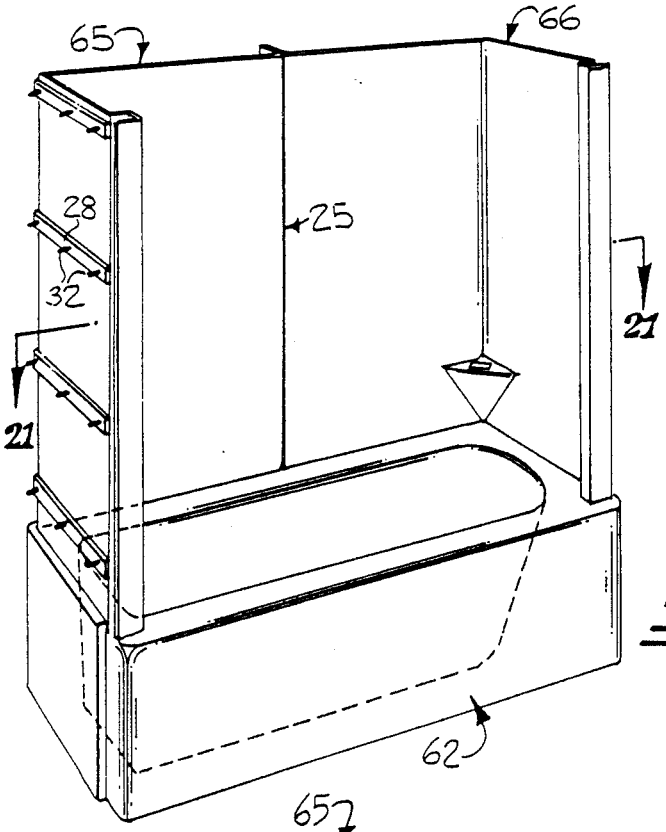
FIG. 20 is a perspective view of a modular bathing cabinet, and specifically a bathing tub in accordance with still another embodiment of the present invention.
Figure 21:
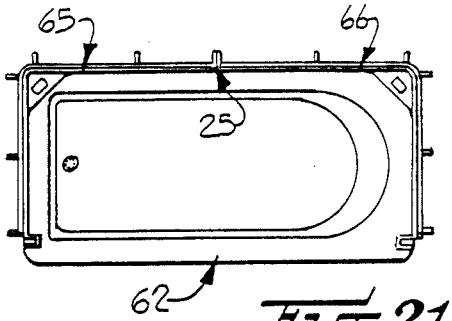
FIG. 21 is a horizontal sectional view, on a reduced scale, and taken substantially along the line 21—21 of FIG. 20.
Figure 22:
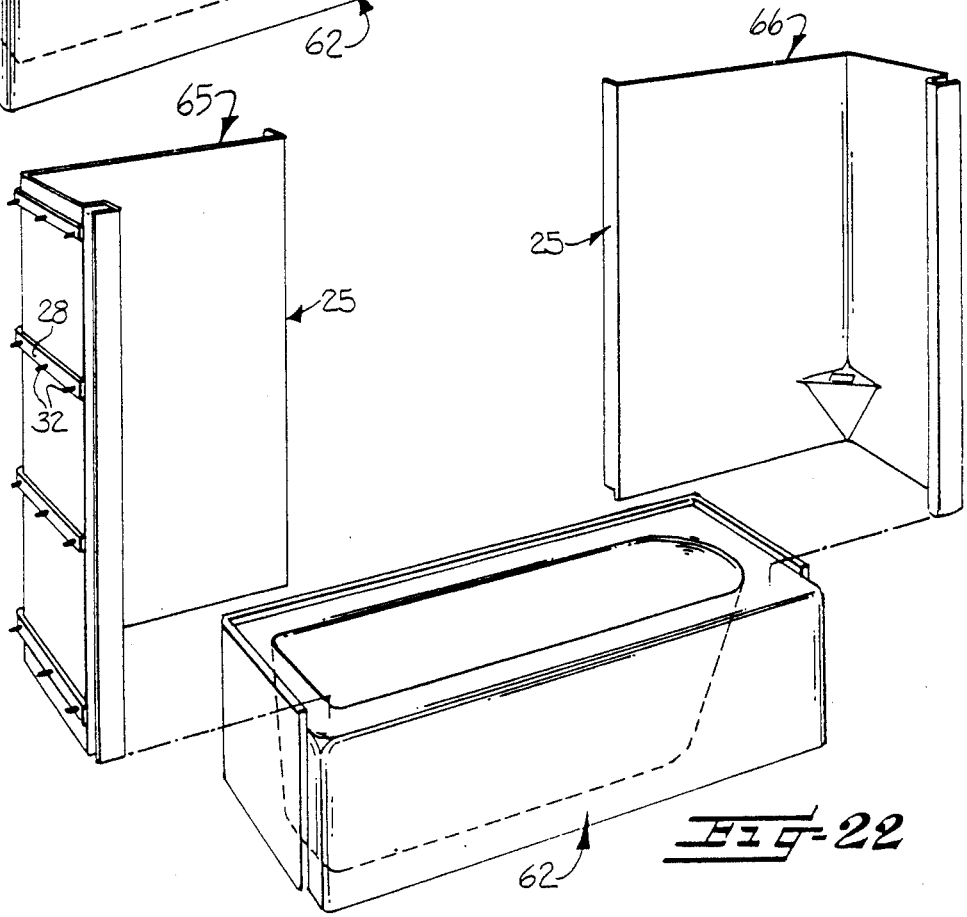
FIG. 22 is an exploded perspective view of the bathing tub shown in FIG. 20.

FIGS. 20–22 illustrate a further embodiment of the invention, and wherein the base 62 is in the form of an elongate bathing tub which is sized to receive the user in a seated position therein, and the enclosure is in the form of two L-shaped side sections 65, 66. The tub 62 includes an upwardly extending lip 64 extending along the back side and two ends in the manner best seen in FIG. 22, and so as to be positioned along the outside of the lower edge of the enclosure of the finished cabinet. The side sections 65, 66 are generally similar in construction to the side sections 18, 19 of the enclosure for the embodiment of FIGS. 1–4, with the exception that the seat has been omitted, and the grab bar and water nozzle have also been omitted. As will be apparent however the grab bar and water nozzle may readily be added if desired in a particular installation.

In the embodiments specifically illustrated herein, the enclosure is illustrated as being composed of two L-shaped side sections 18 and 19. It will be understood however that the present invention could be fabricated from three side sections, which would respectively comprise the back wall 14 and the two opposite side walls 16, 17 in their assembled condition. In such embodiment, there would be two vertical junction lines along the two back corners of the enclosures, and the three side sections would be joined along each of these junction lines by the structure substantially as shown in FIG. 5.

In the drawings and specification, there has been set forth preferred embodiments of the invention, and although specific terms are employed, they are used in a generic and descriptive sense only and not for purposes of limitation.

I claim:

1. A modular bathing cabinet which is adapted to be transported in a disassembled condition and assembled at the location of final installation and use, and comprising a horizontally disposed base having a generally rectangular outer periphery in plan view, and including an aperture for receiving a drain, an enclosure of generally U-shape in horizontal cross-section and having a vertical back wall, opposite vertical side walls, and an open front, with said enclosure being positioned upon the outer periphery of said base and extending vertically upwardly therefrom, and with said enclosure comprising a plurality of upright side sections which are positioned in an adjacent side by side arrangement and define a vertical junction line between each adjacent pair, each of said upright side sections including an integral outwardly extending flange along each adjacent vertical junction line, with the flanges of adjacent side sections being parallel to and overlying each other, and a plurality of rigid reinforcing straps affixed to each of said upright side sections and disposed along the outside surface of each of said upright side sections, with said reinforcing straps of each side section extending horizontally and in a vertically spaced apart arrangement, and with each reinforcing strap of each side section being horizontally aligned with a respective one of the reinforcing straps of each adjacent side section, and means interconnecting the horizontally aligned straps across each vertical junction line and so as to press the overlying flanges toward each other, and so as to define a plurality of horizontal reinforcing bands which extend continuously along the back wall and both side walls of said enclosure, each of said reinforcing straps further including a plurality of securing members connected to and extending outwardly therefrom and adapted to be engaged with and secured to a building wall stud or the like.

2. The modular bathing cabinet as defined in claim 1 wherein said reinforcing straps each include an outwardly directed extension adjacent each vertical junction line, with the extensions of the interconnected straps being parallel to each other and overlying the outer surface of the associated flanges, and said strap interconnecting means comprises bolt means rigidly interconnecting said extensions across each vertical junction line.

3. The modular bathing cabinet as defined in claim 2 wherein each of said bolt means extends through the associated extensions and flanges.

4. The modular bathing cabinet as defined in claim 3 further comprising a sealing strip interposed between each overlying pair of said flanges of said upright side sections.

5. A modular bathing cabinet which is adapted to be transported in a disassembled condition and assembled at the location of final installation and use, and comprising a horizontally disposed base having a generally rectangular outer periphery in plan view, and including an aperture for receiving a drain, an enclosure of generally U-shape in horizontal cross-section and having a vertical back wall, opposite vertical side walls, and an open front, with said enclosure being positioned upon the outer periphery of said base and extending vertically upwardly therefrom, and with said enclosure comprising a pair of L-shaped upright side sections, with each of said side sections comprising a rear panel and a side panel which are disposed at right angles to each other and such that the rear panels of said side sections are aligned along a vertical junction line and collectively define said back wall of said enclosure, and said side panels define respective ones of said side walls of said enclosure, each of said upright side sections including an integral outwardly extending flange along said vertical junction line, with the flanges of the two side sections being parallel to and overlying each other, and a plurality of rigid reinforcing straps affixed to each of said upright side sections and disposed along the outside surface of each of said upright side sections, with said reinforcing straps of each side section extending horizontally along the side panel and rear panel thereof and in a vertically spaced apart arrangement, and with each reinforcing strap of each side section being horizontally aligned with a respective one of the reinforcing straps of the other side section at said vertical junction line, and means interconnecting the horizontally aligned straps across said vertical junction line and so as to press the overlying flanges toward each other, and so as to define a plurality of horizontal reinforcing bands which extend continuously along the back wall and both side walls of said enclosure, each of said reinforcing straps further including a plurality of securing members connected to and extending outwardly therefrom and adapted to be engaged with and secured to a building wall stud or the like.

6. The modular bathing cabinet as defined in claim 5 wherein said reinforcing straps each include an outwardly directed extension adjacent said vertical junction line, with the extensions of the interconnected straps being parallel to each other and overlying the outer surface of the associated flanges, and said strap interconnecting means comprises bolt means rigidly interconnecting said extensions across said vertical junction line.

7. The modular bathing cabinet as defined in claim 6 wherein each of said bolt means extends through the associated extensions and flanges.

8. The modular bathing cabinet as defined in claim 7 further comprising a sealing strip interposed between said flanges of said upright side sections.

9. The modular bathing cabinet as defined in claim 5 wherein each of said upright side sections further includes an inwardly directed horizontal ledge extending along substantially the full length of said side panel and rear panel thereof, with the ledges of the two side sections being horizontally aligned, and further comprising a horizontal seat disposed upon and secured to the horizontal ledge of at least one of said side sections.

10. The modular bathing cabinet as defined in claim 5 wherein said side sections are formed of a molded material, and wherein at least one of said side sections includes an integrally formed horizontal seat extending substantially the full length of said side panel and said rear panel thereof.

11. The modular bathing cabinet as defined in claim 5 wherein at least one of said side sections includes a seat mounted thereto for pivotable movement between a horizontal operative position and a raised storage position.

12. The modular bathing cabinet as defined in claim 5 wherein said base includes an upwardly extending lip extending along said outer periphery thereof and so as to be positioned along the outside of the lower edge of said enclosure.

13. The modular bathing cabinet as defined in claim 5 further comprising a horizontally directed grab bar mounted within said enclosure, with said grab bar being aligned with one of said reinforcing straps, and means interconnecting said grab bar to said one reinforcing strap.

14. The modular bathing cabinet as defined in claim 5 further comprising a water outlet nozzle mounted on the inside surface of said side panel of at least one of said upright side sections.

15. The modular bathing cabinet as defined in claim 5 wherein said base includes a generally horizontal bottom wall which is adapted to have the user stand thereupon.

16. The modular bathing cabinet as defined in claim 5 wherein said base is in the form of an elongate bathing tub adapted to receive the user in a seated position therein.

17. A method of installing a modular bathing cabinet of the type comprising a horizontally positionable base having a generally rectangular outer periphery in plan view and including an aperture for receiving a drain, and a pair of side sections positioned in an adjacent side-by-side arrangement to define a junction line between the adjacent pair which is vertical with respect to the horizontally positionable base, with each side section comprising a rear panel and a side panel which are disposed at right angles to each other, with each of said side sections having a plurality of reinforcing straps affixed thereto in vertically spaced apart arrangement and so as to extend along the outside surface of the side panel and rear panel, and with said reinforcing straps including a plurality of securing members extending outwardly therefrom, and comprising the steps of mounting the base upon a horizontal supporting floor, connecting a drain to the aperture of the base, mounting a plurality of vertical wall studs to said supporting floor so as to be positioned along opposite sides of said base when the base is mounted upon said floor, securing said pair of side sections to each other by interconnecting respective ones of said straps at the vertical junction line, and so as to form a U-shaped enclosure having a back wall, opposite side walls, and an open front, positioning said enclosure upon said base so as to define a bathing cabinet with an open front, and securing said securing members of said straps to said vertical wall studs.

18. The method as defined in claim 17 wherein each of said side sections further includes an inwardly directed horizontal ledge extending along substantially the full length of said side panel and rear panel thereof, and with the ledges of the two side sections being horizontally aligned upon said pair of side sections being secured to each other, and comprising the further step of mounting a horizontal seat upon the horizontal ledge of at least one of said side sections.

19. The method as defined in claim 17 wherein the step of securing said pair of side sections to each other occurs subsequent to securing said securing members of said straps of one of said side sections to said vertical wall studs, and the securing of said securing members of said straps of the other of said side sections to said vertical wall studs occurs subsequent to the step of securing said pair of side sections to each other.

20. The method as defined in claim 17 wherein each of said side sections includes an integral outwardly extending flange along the vertical junction line, with the flanges of the side sections being parallel to and overlying each other, and wherein the step of securing the pair of side sections to each other includes interconnecting respective ones of said straps across the vertical junction line so as to press the overlying flanges towards each other.

* * * * *